US009175512B2

(12) United States Patent
Lu et al.

(10) Patent No.: US 9,175,512 B2
(45) Date of Patent: Nov. 3, 2015

(54) CURTAIN PULL BEAD FIXING APPARATUS

(71) Applicant: NINGBO XIANFENG NEW MATERIAL CO., LTD., Ningbo, Zhejiang Province (CN)

(72) Inventors: Xianfeng Lu, Ningbo (CN); Jianhua Sang, Ningbo (CN)

(73) Assignee: NINGO XIANFENG NEW MATERIAL CO., LTD., Ningbo (CN)

( * ) Notice: Subject to any disclaimer, the term of this patent is extended or adjusted under 35 U.S.C. 154(b) by 0 days.

(21) Appl. No.: 14/286,658

(22) Filed: May 23, 2014

(65) Prior Publication Data

US 2014/0359976 A1 Dec. 11, 2014

(30) Foreign Application Priority Data

Jun. 6, 2013 (CN) ..... 2013 2 0328593 U

(51) Int. Cl.
*E06B 9/32* (2006.01)
*E06B 9/42* (2006.01)
*E06B 9/326* (2006.01)

(52) U.S. Cl.
CPC . *E06B 9/42* (2013.01); *E06B 9/326* (2013.01); *Y10T 24/3904* (2015.01)

(58) Field of Classification Search
USPC ..... 24/116 A, 116 R, 177 R, 115 R, 130, 24/131 C; 160/173 R, 321, 332, 177 V, 228, 160/168.1 R, 168.1 V, 173 V, 178.1 V, 160/178.1 R, 84.04, 24, 344, 178.2
See application file for complete search history.

(56) References Cited

U.S. PATENT DOCUMENTS

| | | | | | |
|---|---|---|---|---|---|
| 4,372,432 | A * | 2/1983 | Waine et al. | ..... | 192/223.4 |
| 4,865,109 | A * | 9/1989 | Sherman | ..... | 160/321 |
| 5,137,073 | A * | 8/1992 | Huang | ..... | 160/321 |
| 5,752,558 | A * | 5/1998 | Lin | ..... | 160/320 |
| 5,845,696 | A * | 12/1998 | Chou | ..... | 160/178.1 V |
| 6,116,325 | A * | 9/2000 | Colson et al. | ..... | 160/321 |
| 6,158,563 | A * | 12/2000 | Welfonder et al. | ..... | 192/223.3 |
| 6,173,825 | B1 * | 1/2001 | Liu | ..... | 192/223.4 |
| 6,739,373 | B1 * | 5/2004 | Liu et al. | ..... | 160/321 |
| 7,195,052 | B2 * | 3/2007 | Nien et al. | ..... | 160/321 |
| 7,931,069 | B2 * | 4/2011 | Cannaverde et al. | ..... | 160/173 R |
| 8,136,569 | B2 * | 3/2012 | Bohlen et al. | ..... | 160/323.1 |

(Continued)

FOREIGN PATENT DOCUMENTS

| | | | |
|---|---|---|---|
| CN | 2849109 | Y | 12/2006 |
| CN | 200943432 | Y | 9/2007 |

(Continued)

*Primary Examiner* — Robert J Sandy
*Assistant Examiner* — Rowland Do
(74) *Attorney, Agent, or Firm* — Cheng Law Group, PLLC

(57) ABSTRACT

A curtain pull bead fixing apparatus includes a stationary seat, a bottom cover, a bead disk, a button, a spring, a main body, a slider and a front cover. One side of the stationary seat is assembled with the bottom cover, and the other side of the bottom cover is fixedly connected with the main body. The other side of the main body is fixedly connected with the front cover. A through hole is formed in the bottom cover for passage of the button, and the first end of the button is pressed against the stationary seat. The pull bead is in a tensioned state all the time and will not collide with the surface of the wall even under an external force. The children could not play with the pull bead by wrapping the same around their neck, which brings about high safety.

12 Claims, 10 Drawing Sheets

(56) References Cited

U.S. PATENT DOCUMENTS

| | | | | |
|---|---|---|---|---|
| 8,156,993 | B2 * | 4/2012 | Kao | 160/321 |
| 8,302,335 | B2 * | 11/2012 | Wang | 40/514 |
| 8,893,766 | B2 * | 11/2014 | Bohlen | 160/323.1 |
| 2007/0056699 | A1 * | 3/2007 | Liu | 160/321 |
| 2007/0084570 | A1 * | 4/2007 | Lin | 160/321 |
| 2007/0107857 | A1 * | 5/2007 | Wang | 160/321 |
| 2012/0255686 | A1 * | 10/2012 | Huang | 160/293.1 |

FOREIGN PATENT DOCUMENTS

| | | | |
|---|---|---|---|
| CN | 101089355 | A | 12/2007 |
| CN | 201574680 | U | 9/2010 |
| CN | 201602589 | U | 10/2010 |
| CN | 201747245 | U | 2/2011 |
| CN | 202266181 | U | 6/2012 |
| EP | 2 284 353 | A2 | 2/2011 |

* cited by examiner

CURTAIN PULL BEAD FIXING APPARATUS

CROSS REFERENCE TO RELATED APPLICATIONS

The present application claims priority to Chinese Patent Application No. 201320328593.5 filed on Jun. 6, 2013, the entire contents of which are hereby incorporated by reference into the present application.

BACKGROUND OF THE INVENTION

1. Field of Invention

The present invention relates to the technical field for manufacturing sunshade products, in particular, to a curtain pull bead fixing apparatus.

2. Related Art

In the conventional lifting mechanism for curtains, it is a very ordinary means to employ pull beads for driving. However, in the conventional structures, the lower end of the bead chain is unfixed and flyable, and would collide with the surface of a wall or a glass window to make sounds when being driven by an external force, for example being blown by wind. More seriously, some safety issues would occur. For example, a child once put the bead chain around the neck and was thus suffocated in the United States. Therefore, it is prohibited in the United States using pull beads without any safety measures to drive a curtain.

In order to address the safety issues incurred by flying the lower end of the bead chain, a technical solution is disclosed in the state of art as follows. A Chinese Utility Model Patent, the publication number of which is CN201602589U, discloses a fixing device for a curtain chain bead winding rope, in which a telescopic member is provided in the fixing device for the bead chain to restrict the rotation of the bead china. The said fixing device nonetheless has a too simple structure to be reliable and unbreakable.

Additionally, a Chinese Utility Model Patent, the publication number of which is CN202266181U, discloses a manual shutter curtain safety protection device including an installation box, a bead disk, a positioning post and a spring. When the curtain is not mounted, the bead disk is engaged with the positioning post to lock the bead disk, so that the bead disk will not rotate while being pulled by an external force. When the curtain is mounted, the positioning post is released from the bead disk so that the bead disk could rotate, and the bead chain is limited into the installation box and thus could not fly in the meantime.

Even though the aforesaid technical solutions have addressed the problem that the lower end of the bead chain is likely to fly with wind, the bead chain could still be used in the untensioned state when the bead chain is used, and the bead chain body, for example the middle or front portion of the bead chain, could still be flying, for which safety issues might exist.

SUMMARY OF THE INVENTION

It is therefore an object of the present invention to provide a curtain pull bead fixing apparatus, in which the lower end of the pull bead is positioned in such a manner that the pull bead is always in a tensioned state in use. As the lower end is positioned and in a tensioned state in use, the bead chain would not collide with the surface of the wall or glass to make sound under an external force, and the children might be choked for misoperation.

The present invention discloses a curtain pull bead fixing apparatus, comprising a stationary seat, a bottom cover, a bead disk, a button, a spring, a main body, a slider and a front cover. One side of the stationary seat is assembled with the bottom cover, and the other side of the bottom cover is fixedly connected with the main body. The other side of the main body is fixedly connected with the front cover. A through hole is formed in the bottom cover for passage of the button, and the first end of the button is pressed against the stationary seat. A hole is formed in the button extending through the second end of the button, and a spring is mounted into the hole. The outer end of the spring is pressed against the inner wall of the front wall. The bead disk is rotably covered outside of the button and used for positioning the lower end of the curtain pull bead. The main body has two channels for passage of the curtain pull bead. The slider is mounted on the main body and the slider is covered outside and engaged with a part of the button.

Preferably, the slider could slide longitudinally along the main body and a pressure spring is located between the main body and the slider and pressed upward against the slider.

Preferably, the stationary seat slidably cooperates with the bottom cover in a longitudinal direction. The button could longitudinally slide along the through hole of the bottom cover. A protrusion is formed at the bottom of the through hole of the bottom cover, and correspondingly a slot is formed in the button and engaged with the protrusion.

Preferably, a square hole is provided on the main body, and the slider is located within the square hole, in which the height of the square hole is larger than that of the slider.

Preferably, a post is provided on the main body and located above the square hole opposite to the pressure spring.

Preferably, two longitudinal chutes are formed on the stationary seat, and correspondingly, two longitudinal chutes are formed on the bottom cover. The projecting edges adjacent to the bottom cover chutes are positioned into the chutes of the stationary seat, and the projecting edges adjacent to the chutes of the stationary seat are located into the chutes of the bottom cover.

Preferably, longitudinal teeth are formed on the stationary seat, and the upper part of each tooth is an upward slope and the lower part thereof is a plane downward. Projecting flexible blocks are formed on the bottom cover and have a longitudinal section of a right trapezoid. The plane is located at the upper part and the slope is located at the lower part and faces downward. The blocks of the bottom cover are engaged with the teeth of the stationary seat.

Preferably, the through hole of the bottom cover has an oval shape in the longitudinal direction. The body of the button is cylindrical and the outer diameter of the cylindrical body coincides with the width of the oval through hole of the bottom cover and is smaller than the height of the oval through hole of the bottom cover.

Preferably, several arc-shaped grooves are formed on the outer ring of the bead disk. A stop arm extends from one side of the arc-shaped groove and the stop arms of adjacent arc-shaped grooves are positioned on different sides. The arc-shaped grooves are matched with the beads of the pull bead.

Preferably, a round hole is formed on the stop arm.

Preferably, catches are formed on the bottom cover, and correspondingly, button holes are formed in the main body, so that the bottom cover could be assembled with the main body by engaging the catches with button holes.

Preferably, positioning posts are formed on the bottom cover, and positioning holes are formed in the main body. The positioning posts of the bottom cover extend into the positioning holes of the main body.

Preferably, a second button hole is formed in the main body, and correspondingly a catch is formed on the front cover. The front cover could be assembled with the main body by engaging the catch with the second button hole.

The lower end of the pull bead is positioned by the curtain pull bead fixing apparatus of the invention. As such, the pull bead is in a tensioned state all the time and will not collide with the surface of the wall or the glasses even under an external force. Moreover, the children could not play with the pull bead by wrapping the same around their neck, which brings about high safety.

The curtain pull bead fixing apparatus of the invention could be assembled conveniently, and has a simple structure, a low manufacturing cost and high safety.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Embodiments of the present invention will be described in detail below with reference to the drawings.

Figure 1:
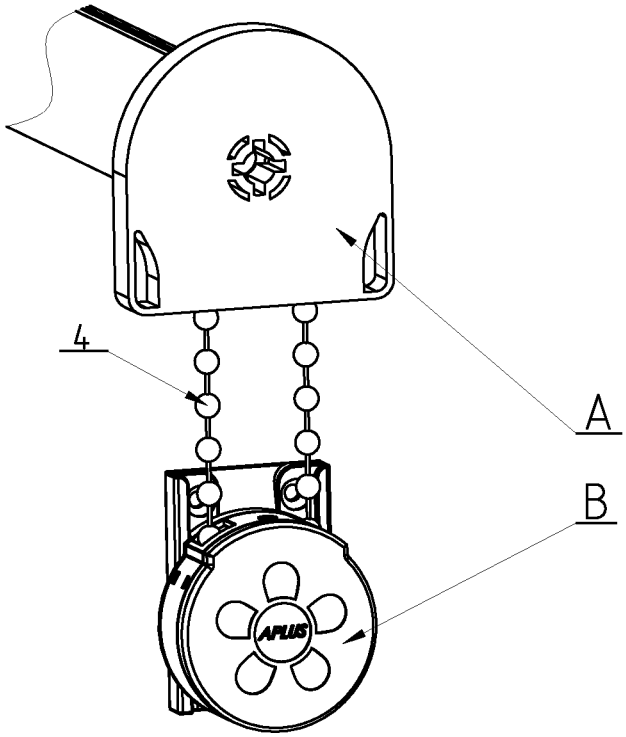
FIG. 1 is a view of the assembly of the curtain pull bead fixing apparatus and the curtain brake.
Figure 2:
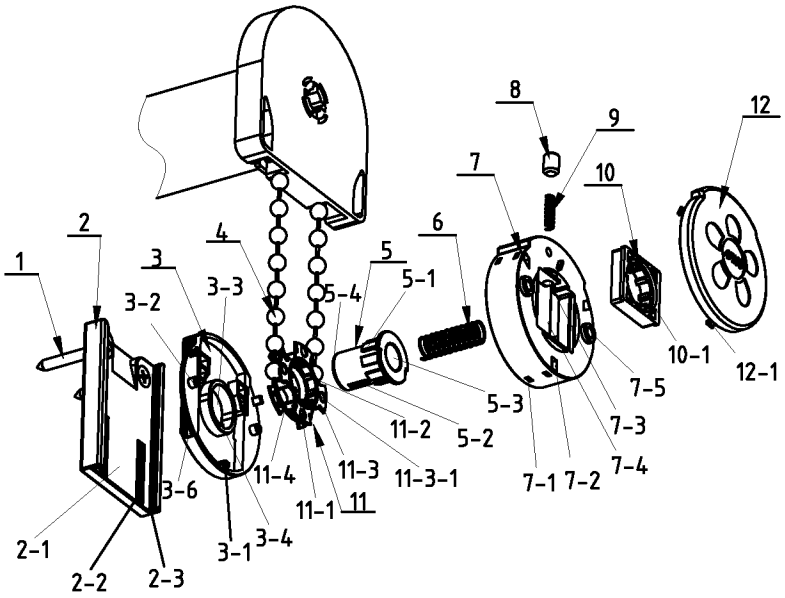
FIG. 2 is an exploded view of the part B.
Figure 4:
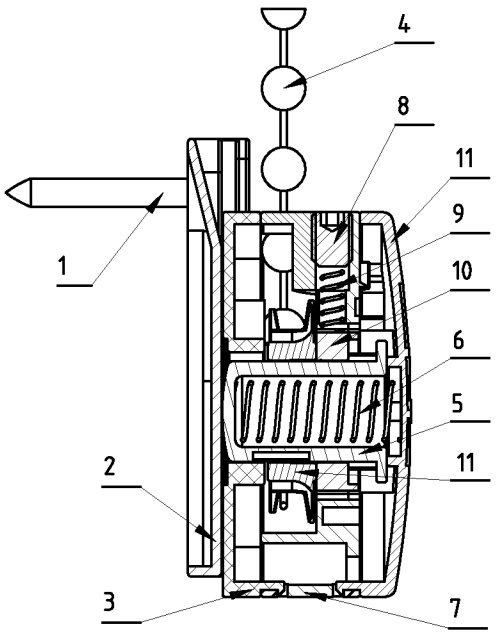
FIG. 4 is a section view along A-A of FIG. 3.
Figure 3:
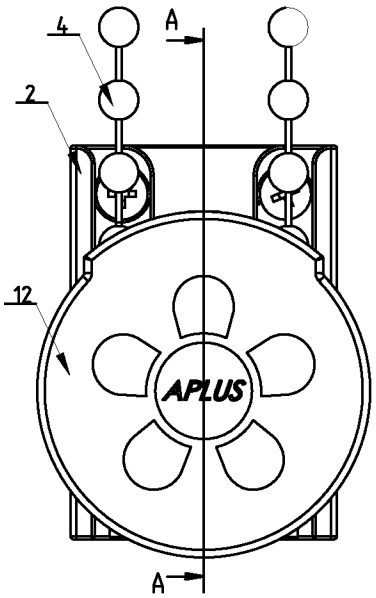
FIG. 3 is a front view of the front cover.
Figure 5:
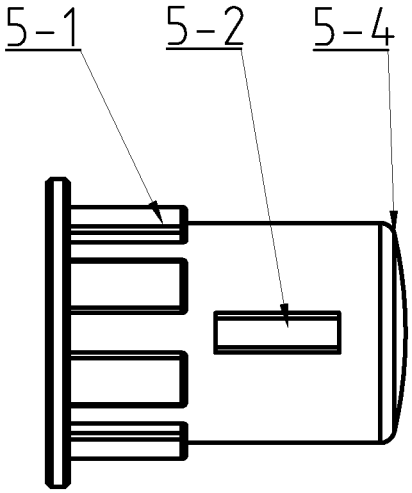
FIG. 5 is a side view of the button.
Figure 6:
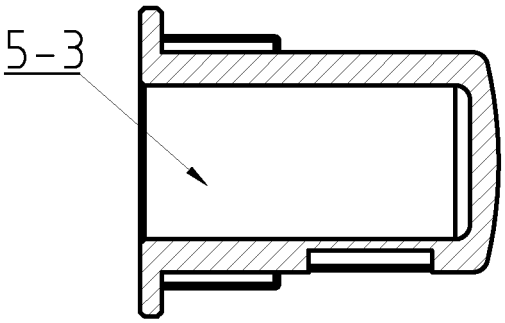
FIG. 6 is a longitudinal section view of the button.
Figure 7:
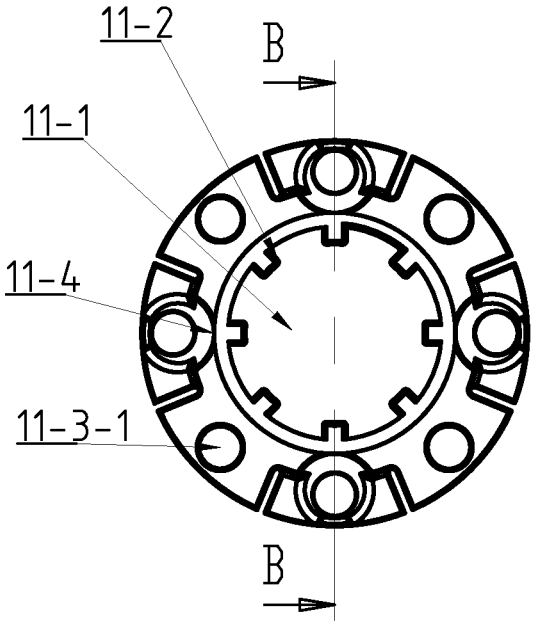
FIG. 7 is a front view of the bead disk.
Figure 8:
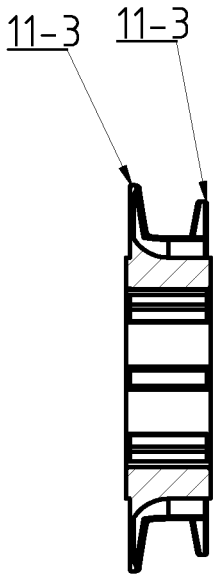
FIG. 8 is a section view along B-B of FIG. 7.
Figure 10:
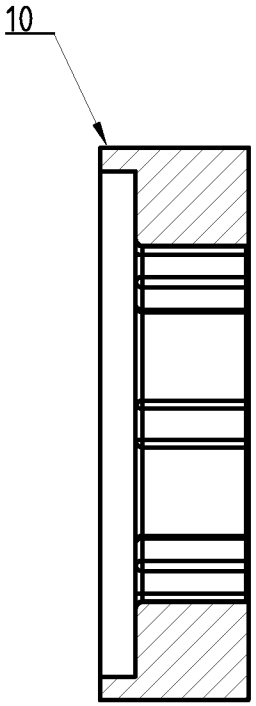
FIG. 10 is a section view along C-C of FIG. 9.
Figure 9:
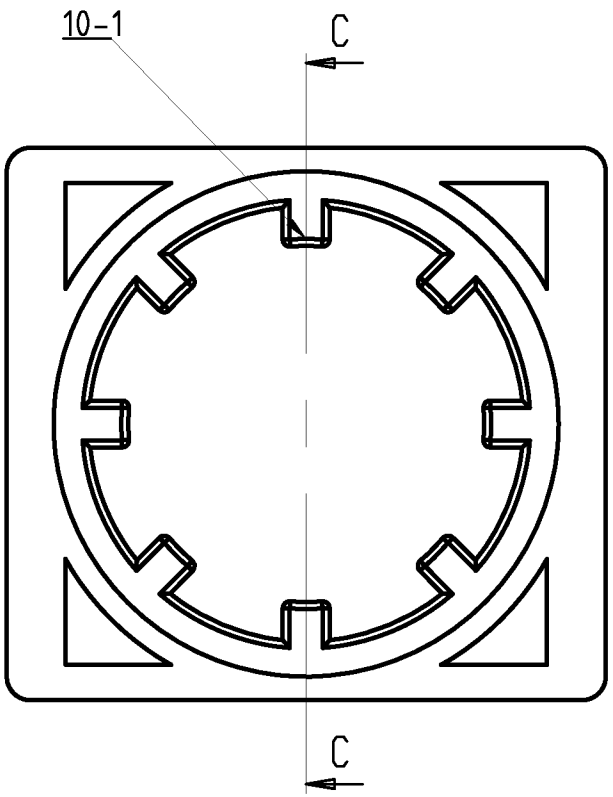
FIG. 9 is a front view of the slider.
Figure 12:
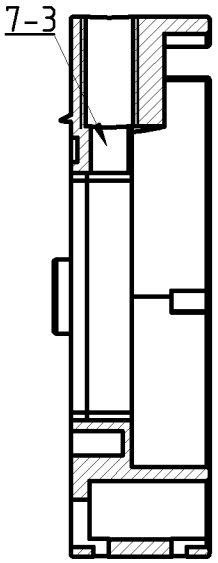
FIG. 12 is a section view along D-D of FIG. 11.
Figure 11:
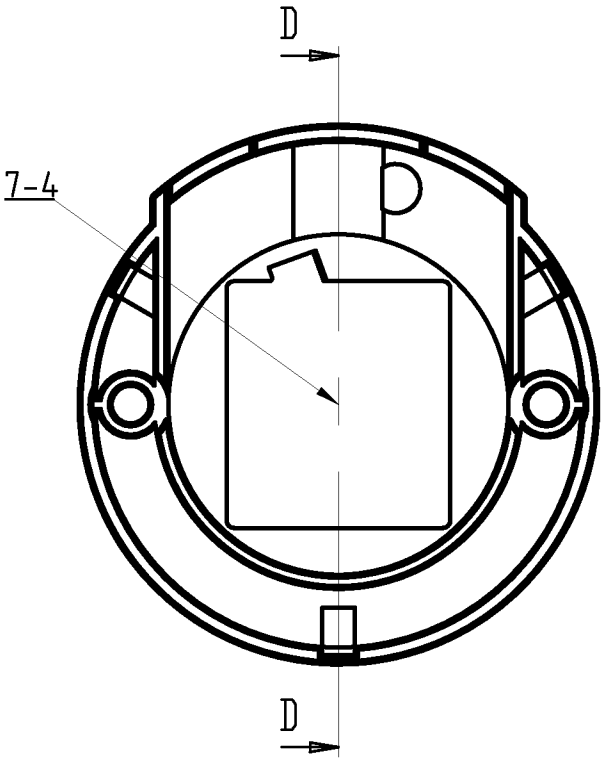
FIG. 11 is a front view of the main body.
Figure 14:
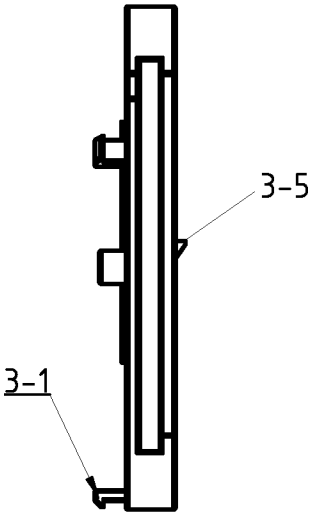
FIG. 14 is a side view of the bottom cover.
Figure 13:
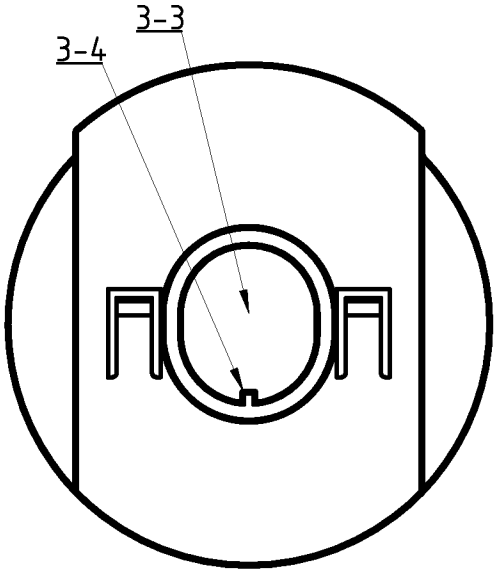
FIG. 13 is a front view of the bottom cover.
Figure 16:
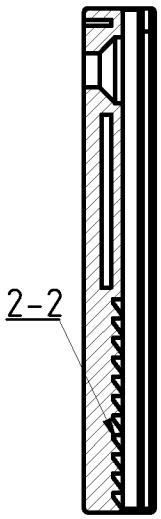
FIG. 16 is a section view along E-E of FIG. 5.
Figure 15:
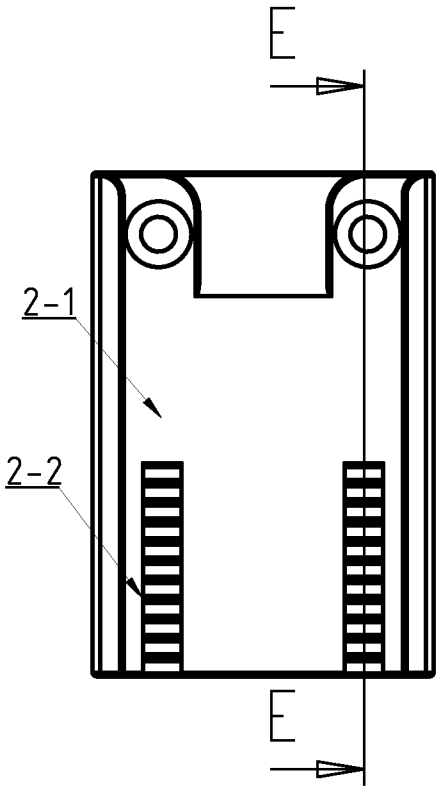
FIG. 15 is a front view of the stationary seat.
Figure 18:
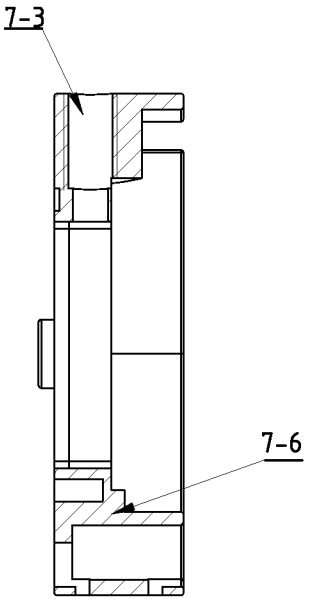
FIG. 18 is a section view along F-F of FIG. 17.
Figure 17:
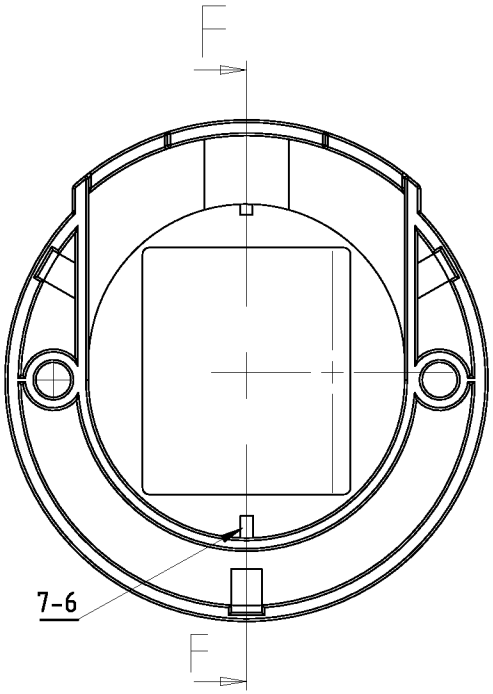
FIG. 17 is a front view of the main body according to another embodiment of the invention.

Referring to FIG. 1, the curtain pull bead 4 is comprised of several beads connected in series on the round pull string in which the beads are spaced from each other. The upper part of the pull bead 4 is located at and moves with the curtain brake A; and the lower part thereof is located at and moves with the curtain pull bead fixing apparatus B.

With reference to FIGS. 2-16, the curtain pull bead fixing apparatus B of this embodiment includes a stationary seat 2, a bottom cover 3, a bead disk 11, a button 5, a control spring 6, a main body 7, a slider 10 and a front cover 12. The stationary seat 2 is cuboid and fixed to the wall or window frame through two self-tapping screws 1 and the inner side thereof adheres to the wall or window frame.

The outer side 2-1 of the stationary seat 2 comprises two rows of longitudinal teeth 2-2, in which each tooth has an upper part shaped as an upward slope and a lower part shaped as a downward plane. Two longitudinal edges of the outer side 2-1 continuously turn by 90 degrees twice respectively to form two longitudinal chutes 2-3 which are faced opposite to each other.

Two longitudinal chutes 3-6 are formed on one side of the bottom cover 3 and two projecting flexible blocks 3-5. Two longitudinal chutes 3-6 of the bottom cover 3 are matched with two chutes 2-3 of the stationary seat 2. In particular, the projecting edges adjacent to the chutes 3-6 of the bottom cover are positioned into the chutes 2-3 of the stationary seat 2, and the projecting edges adjacent to the chutes 2-3 of the stationary seat are located into the chutes 3-6 of the bottom cover 3, so that the bottom cover 3 is slidably adapted to the stationary seat 2.

The flexible blocks 3-5 of the bottom cover have a longitudinal section of a right trapezoid, in which the plane is located at the upper part and the slope is located at the lower part and faces downward and outside. The blocks 3-5 of the bottom cover 3 are matched with the teeth 2-2 of the stationary seat 2. In other words, the blocks 3-5 are engaged with the teeth 2-2 of the stationary seat 2. The bottom cover 3 could only slide downward and could not slide upward, for which the tension of the pull bead is thus adjusted.

A through hole 3-3 is formed in the middle of the bottom cover 3 and has an oval shape and an upward protrusion 3-4 is formed at the bottom. The button 5 passes through the through hole 3-3 of the bottom cover 3. The body of the button 5 has a cylindrical shape, the outer diameter of the cylindrical body coincides with the width of the oval through hole 3-3 and is smaller than the height of the oval through hole 3-3, so that the button 5 could translate up and down along the bottom cover 3. The inner end 5-4 of the button 5 passes the through hole 3-3 of the bottom cover 3 and then is pressed against the outer side 2-1 of the stationary seat 2. The lower part of the button body adjacent to the inner end 5-4 has a slot 5-2. The slot 5-2 is provided in the lengthwise direction of the button 5 and matched with the protrusion 3-4 of the bottom cover 3. That is to say, the protrusion 3-4 of the bottom cover 3 is inserted into and engaged with the slot 5-2. Alternatively, no slot is provided at the lower part of the button body and the bottom cover 3 is not provided with any corresponding protrusion. Instead, a post 7-6 is provided on the main body 7 and the bead disk 11 is engaged with the post 7-6 after the button 5 is pressed.

The other end of the button 5 is a cap, the outer diameter of which is slightly larger than the button body, and teeth 5-1 are formed on the outer wall adjacent to this end. The button 5 is provided with an inner cylindrical hole 5-3 in the lengthwise direction which is in communication with the external environment through the cap. A control spring 6 is located within the cylindrical hole 5-3.

The lower end of the curtain pull bead 4 is located at the bead disk 11. The bead disk 11 is configured in such a manner that the bead disk 11 has a through hole 11 and inner teeth 11-2 are formed on the inner wall of the through hole. The through hole 11-1 of the bead disk passes through the body of the button 5 without teeth, and is thus engaged with the body of the button and could not rotate. The outer ring of the bead disk 11 forms two side stop arms 11-3 which are evenly located along two edges of the outer ring of the bead disk 11 respectively and spaced from each other. A round hole 11-3-1 is formed on the stop arm 11-3 and matched with the bead of the pull bead 4. The spacing of adjacent round holes 11-3-1 on two sides coincides with the spacing of adjacent beads of the pull bead 4. An arc-shaped groove 11-4 is formed on the outer ring of the bead disk corresponding to each stop arm 11-3 (round hole) and matched with the bead of the pull bead 4. The beads of the pull bead 4 are positioned by means of the positioning effect of the arc-shaped groove and round holes 11-3-1 on the stop arms 11-3.

The main body 7 is mounted on the outer side of the bottom cover 3. Two positioning posts 3-2 are formed on the outer side of the bottom cover 3. Three catches 3-1 are formed on the edge of the said outer side. Correspondingly, two positioning holes 7-5 and three button holes 7-1 are formed in the main body 7. The positioning posts 3-2 of the button cover extend into the positioning holes 7-5 of the main body. The bottom cover 3 is assembled with the main body 7 through the cooperation of the caches 3-1 with the button holes 7-1. The bead disk 11 is located between the bottom cover 3 and the main body 7. Certainly, two channels are provided on the upper wall of the main body 7 and extend into the main body 7 for passage of the pull bead 4.

A square hole 7-4 is provided on the main body 7. A slider 10 having square outer edges is located within the square hole. The width of the square hole coincides with that of the slider, but the height of the square hole 7-4 is larger than that of the slider 10, so that the slider 10 could translate up and down relative to the main body 7. A hole 7-3 is provided on the main body 7 and extends downward to the upper wall of the square hole 7-4. An adjustable pressure spring 9 is mounted within the hole. The upper end of the adjustable pressure spring 9 is pressed against a set screw 8 turning into the hole 7-3 and the lower end thereof is pressed against the upper wall of slider 10.

A circular through hole is provided in the middle of the slider 10. Inner teeth 10-1 are formed on the inner ring of the through hole and engaged with the outer teeth 5-1 of the button 5. One side of the slider 10 is attached to one side of the bead disk 11 and the other side of the bead disk 11 is attached to the corresponding side of the bottom cover 3.

A front cover 12 is mounted on the outer side of the main body 7. Three button holes 7-2 are formed on the outer side of the main body 7 and correspondingly, three catches 12-1 are formed on the front cover 12. The front cover 12 is assembled with the main body 7 by engaging the catches 12-1 with the button holes 7-2.

The inner end of the control spring 6 is pressed against the inner wall of the hole of the button 5 and the outer end thereof is pressed against the inner wall of the front cover 12.

In an initial state, the slider is pressed by the pressure spring 9 against the upper side top wall of the square hole 7-4 of the main body 7. The button 5 is pressed by the control spring 6 out of the circular through hole of the slider 10, so that the outer teeth 5-1 of the button 5 project out of the surface of the slider 10 and the inner teeth 11-2 of the bead disk 11 are engaged with the outer teeth 5-1 to fix the bead disk.

During installation, the cylindrical body of the button 5 passes through the oval through hole 3-3 of the bottom cover and is pressed against the outer side 2-1 of the stationary seat 2 to compress the control spring 6. The outer teeth 5-1 of the button 5 are disengaged from the inner teeth 11-2 of the bead disk 11. In such a case, the slot 5-2 of the button 5 is still engaged with the protrusion 3-4 and the bead disk 11 could not freely rotate. The bottom cover 3 moves downward along the stationary seat 2 in such a manner that slider 10 moves within the square hole 7-4 of the main body to the lower sidewall of the square hole 7-4, the pressure spring 9 is compressed and the slot 5-2 of the button 5 is disengaged from the protrusion 3-4. As such, the bead disk 11 could freely rotate, and the whole bead chain must be in the tensioned state in use thanks to the elastic force of the pressure spring 9. Particularly, the center or other parts of the bead chain would not fly to bring safety problems.

Alternatively, during installation, the cylindrical body of the button 5 passes through the oval through hole 3-3 of the bottom cover and is pressed against t the outer side 2-1 of the stationary seat 2 to compress the control spring 6. The outer teeth 5-1 of the button 5 are disengaged from the inner teeth 11-2 of the bead disk 11. In such a case, the inner side stop arm 11-3 of the bead disk 11 is engaged with the post 7-6 on the main body and the bead disk 11 could not freely rotate. The bottom cover 3 moves downward along the stationary seat 2 in such a manner that slider 10 moves within the square hole 7-4 of the main body to the lower sidewall of the square hole 7-4, the pressure spring 9 is compressed and the inner side stop arm 11-3 of the bead disk 11 is disengaged from the post 7-6. As such, the bead disk 11 could freely rotate, and the whole bead chain must be in the tensioned state in use thanks to the elastic force of the pressure spring 9. Particularly, the center or other parts of the bead chain would not fly to bring safety problems.

It is apparent to those skilled in the art that the specific embodiments described herein are merely illustrative of the spirit of the invention. Various variations, modifications and amendments can be made to these embodiments without departing from the spirit or scope defined by the appended claims.

LIST OF REFERENCE NUMERALS

A curtain brake
B curtain pull bead fixing apparatus
1 self-tapping screw
2 stationary seat
3 bottom cover
4 pull bead
5 button
6 control spring
7 main body
8 set screw
9 adjustable pressure spring
10 slider
11 bead disk
12 front cover

The invention claimed is:

1. A curtain pull bead fixing apparatus, comprising a stationary seat, a bottom cover, a bead disk, a button, a spring, a main body, a slider and a front cover, in which one side of the stationary seat is assembled with the bottom cover, the other side of the bottom cover is fixedly connected with the main body, and the other side of the main body is fixedly connected with the front cover; a through hole is formed in the bottom cover for passage of the button, and the first end of the button is pressed against the stationary seat; a hole is formed in the button extending through the second end of the button, and the spring is mounted into the hole and the outer end of the spring is pressed against the inner wall of the front cover; the bead disk is rotably covered outside of the button and used for positioning the lower end of the curtain pull bead, and the main body has two channels for passage of the curtain pull bead; and the slider is mounted on the main body and the slider is covered outside and engaged with a part of the button, wherein the slider could slide longitudinally along the main body and a pressure spring is located between the main body and the slider and pressed upward against the slider.

2. The curtain pull bead fixing apparatus of claim 1, wherein the stationary seat slidably cooperates with the bottom cover in a longitudinal direction; and the button could longitudinally slide along the through hole of the bottom cover, a protrusion is formed at the bottom of the through hole of the bottom cover, and correspondingly a slot is formed in the button and engaged with the protrusion.

3. The curtain pull bead fixing apparatus of claim 2, wherein two longitudinal chutes are formed on the stationary seat, and correspondingly, two longitudinal chutes are formed on the bottom cover, in which the projecting edges adjacent to the bottom cover chutes are positioned into the chutes of the stationary seat, and the projecting edges adjacent to the chutes of the stationary seat are located into the chutes of the bottom cover.

4. The curtain pull bead fixing apparatus of claim 2, wherein longitudinal teeth are formed on the stationary seat, and the upper part of each tooth is an upward slope and the lower part thereof is a plane downward; projecting flexible blocks are formed on the bottom cover and have a longitudinal section of a right trapezoid in which the plane is located at the upper part and the slope is located at the lower part and faces downward; and the blocks of the bottom cover are engaged with the teeth of the stationary seat.

5. The curtain pull bead fixing apparatus of claim 2, wherein the through hole of the bottom cover has an oval shape in the longitudinal direction; and the body of the button is cylindrical and the outer diameter of the cylindrical body coincides with the width of the oval through hole of the bottom cover and is smaller than the height of the oval through hole of the bottom cover.

6. The curtain pull bead fixing apparatus of claim 1, wherein a square hole is provided on the main body, and the slider is located within the square hole, in which the height of the square hole is larger than that of the slider.

7. The curtain pull bead fixing apparatus of claim 6, wherein a post is provided on the main body and located above the square hole opposite to the pressure spring.

8. The curtain pull bead fixing apparatus of claim 7, wherein catches are formed on the bottom cover, and correspondingly, button holes are formed in the main body, so that the bottom cover could be assembled with the main body by engaging the catches with button holes.

9. The curtain pull bead fixing apparatus of claim 7, wherein positioning posts are formed on the bottom cover, positioning holes are formed in the main body, and the positioning posts Of the bottom cover extend into the positioning holes of the main body.

10. The curtain pull bead fixing apparatus of claim 8, wherein a second button hole is formed in the main body, and correspondingly a catch is formed on the front cover, and the front cover could be assembled with the main body by engaging the catch with the second button hole.

11. The curtain pull bead fixing apparatus of claim 1, wherein several arc-shaped grooves are formed on the outer ring of the bead disk, a stop arm extends from one side of the arc-shaped groove and the stop arms of adjacent arc-shaped grooves are positioned on different sides; and the arc-shaped grooves are matched with the beads of the pull bead.

12. The curtain pull bead fixing apparatus of claim 11, wherein a round hole is formed on the stop arm.

* * * * *